US010465914B2

(12) United States Patent
Kim

(10) Patent No.: US 10,465,914 B2
(45) Date of Patent: Nov. 5, 2019

(54) COOKING DEVICE

(71) Applicant: LG ELECTRONICS INC., Seoul (KR)

(72) Inventor: Jinhwan Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 89 days.

(21) Appl. No.: 15/064,377

(22) Filed: Mar. 8, 2016

(65) Prior Publication Data

US 2016/0265791 A1 Sep. 15, 2016

(30) Foreign Application Priority Data

Mar. 9, 2015 (KR) ..... 10-2015-0032283

(51) Int. Cl.
*F24C 15/32* (2006.01)
*F24C 3/08* (2006.01)

(52) U.S. Cl.
CPC ..... *F24C 3/087* (2013.01); *F24C 15/322* (2013.01)

(58) Field of Classification Search
CPC ..... F24C 15/32; F24C 15/322
USPC ... 126/273 R, 21 A, 19 R, 21 R, 91 R, 91 A, 126/39 E
See application file for complete search history.

(56) References Cited

U.S. PATENT DOCUMENTS 5,222,474 A * 6/1993 Yencha, III ..... F24C 15/322 126/21 A
5,628,303 A * 5/1997 Ahmady ..... F24D 5/08 126/91 A
2002/0074330 A1* 6/2002 Kim ..... H05B 6/6414 219/757
2012/0266860 A1* 10/2012 Kim ..... F24C 3/087 126/273 R
2014/0144422 A1* 5/2014 Wie ..... F24C 3/087 126/39 E
2014/0174426 A1* 6/2014 Moon ..... F24C 15/322 126/21 A

FOREIGN PATENT DOCUMENTS

JP 2015-7516 A 1/2015
KR 20-1991-0002636 Y1 4/1991
KR 10-2014-0067731 A 6/2014
KR 10-2014-0081154 A 7/2014

* cited by examiner

*Primary Examiner* — Steven B McAllister
*Assistant Examiner* — Rabeeul I Zuberi
(74) *Attorney, Agent, or Firm* — Dentons US LLP

(57) ABSTRACT

A cooking device includes an outer case configured to form an exterior thereof; a cavity provided in the outer case and configured to form a cooking space in which food is cooked; a burner assembly installed in the cavity and configured to cook the food by burning a gas; and an air guide unit which is in communication with the burner assembly and exposes to an outside of the outer case so that air outside the outer case is guided to the burner assembly.

9 Claims, 12 Drawing Sheets

COOKING DEVICE

CROSS-REFERENCE TO RELATED APPLICATION(S)

This present application claims priority under 35 U.S.C. 119 and 35 U.S.C. 365 to Korean Patent Application No. 10-2015-0032283 (filed on Mar. 9, 2015), which is hereby incorporated by reference in its entirety.

BACKGROUND

1. Field

A cooking device is disclosed herein.

2. Background

A cooking device refers to a device for cooking food using heat of a heating source. As an example of a cooking device, an oven range includes an oven chamber in which food is cooked, and a burner which cooks the food in the oven chamber by burning a gas.

In Korean Patent Publication No. 10-2010-0013997, a conventional cooking device is disclosed. The cooking device is provided with a burner assembly under a cavity forming an oven chamber, and a burner for heating food put in the oven chamber by burning a gas is installed at the burner assembly.

In the conventional cooking device, secondary air for combustion of the above burner is introduced into the burner assembly. In the conventional cooking device, the above secondary air is introduced through a lower end portion of the cavity in the cooking device.

However, since the secondary air which flows in the cooking device is introduced into the conventional cooking device, the securement of an amount of the secondary air sufficient for burning is difficult.

Therefore, since the securement of a sufficient amount of the secondary air is difficult in the conventional cooking device, the combustion performance of the burner is degraded.

SUMMARY

The present disclosure is directed to a cooking device.

A cooking device includes an outer case configured to form an exterior thereof; a cavity provided in the outer case and configured to form a cooking space in which food is cooked; a burner assembly installed in the cavity and configured to cook the food by burning a gas; and an air guide unit which is in communication with the burner assembly and exposed to an outside of the outer case so that air outside the outer case is guided to the burner assembly.

One side of the air guide unit may be in communication with the burner assembly, and the other side of the air guide unit may be exposed to the outside of the outer case.

The air guide unit may include a guide body mounted in the cavity to communicate with the burner assembly, and a guide cover mounted on the guide body and exposed to the outside of the outer case.

The burner assembly may include a burner configured to generate a flame by burning the gas, and a burner cover configured to cover the burner, wherein the guide body may be in communication with the burner cover.

A part of the burner cover may be inserted into the air guide unit.

The guide body may be mounted on a lower surface of the cavity.

At least one screw fastening hole for screw-coupling with the cavity may be formed in the guide body.

A receiver configured to form a predetermined accommodation space may be provided on a lower surface of the guide body.

The receiver may be located under a lower surface of the cavity.

The guide cover may cover a part of an upper portion of the guide body so that air introduced from the outside of the outer case is guided to the burner assembly.

An air inlet through which air outside the outer case is introduced may be formed in the guide cover.

The air inlet may be exposed to the outside of the outer case and provided with a plurality of holes.

The plurality of holes may be separated a predetermined distance from each other and disposed in a lengthwise direction of the guide cover The plurality of holes may be disposed in a form of at least one row in a lengthwise direction of the guide cover.

The plurality of holes may have circular or tetragonal shapes.

A cover mounting part may be provided on each of side surfaces of the guide cover, and the cover mounting part may be bent on each of the side surfaces of the guide body to fix the guide cover to the guide body.

The burner assembly may be located in the cavity.

A cooking device includes an outer case configured to form an exterior thereof; a cavity provided in the outer case and configured to form a cooking space in which food is cooked; a burner assembly installed in the cavity and configured to cook the food by burning a gas; and an air guide unit in communication with the burner assembly, wherein one part of the air guide is located between the cavity and the outer case and another part thereof protrudes to the outside of the outer case so that air outside the outer case is guided to the burner assembly.

The burner assembly may be installed at a rear wall of the cavity in the cavity, and the air guide unit is installed at a lower surface of the cavity.

The burner assembly may include a burner and a burner cover configured to cover the burner, wherein a part of the burner cover may pass through the cavity to communicate with the air guide unit.

The part of the burner cover passing through the cavity may be inserted into the air guide unit.

BRIEF DESCRIPTION OF THE DRAWINGS

Embodiments will be described in detail with reference to the following drawings in which like reference numerals refer to like elements, and wherein.

DETAILED DESCRIPTION

Figure 1:
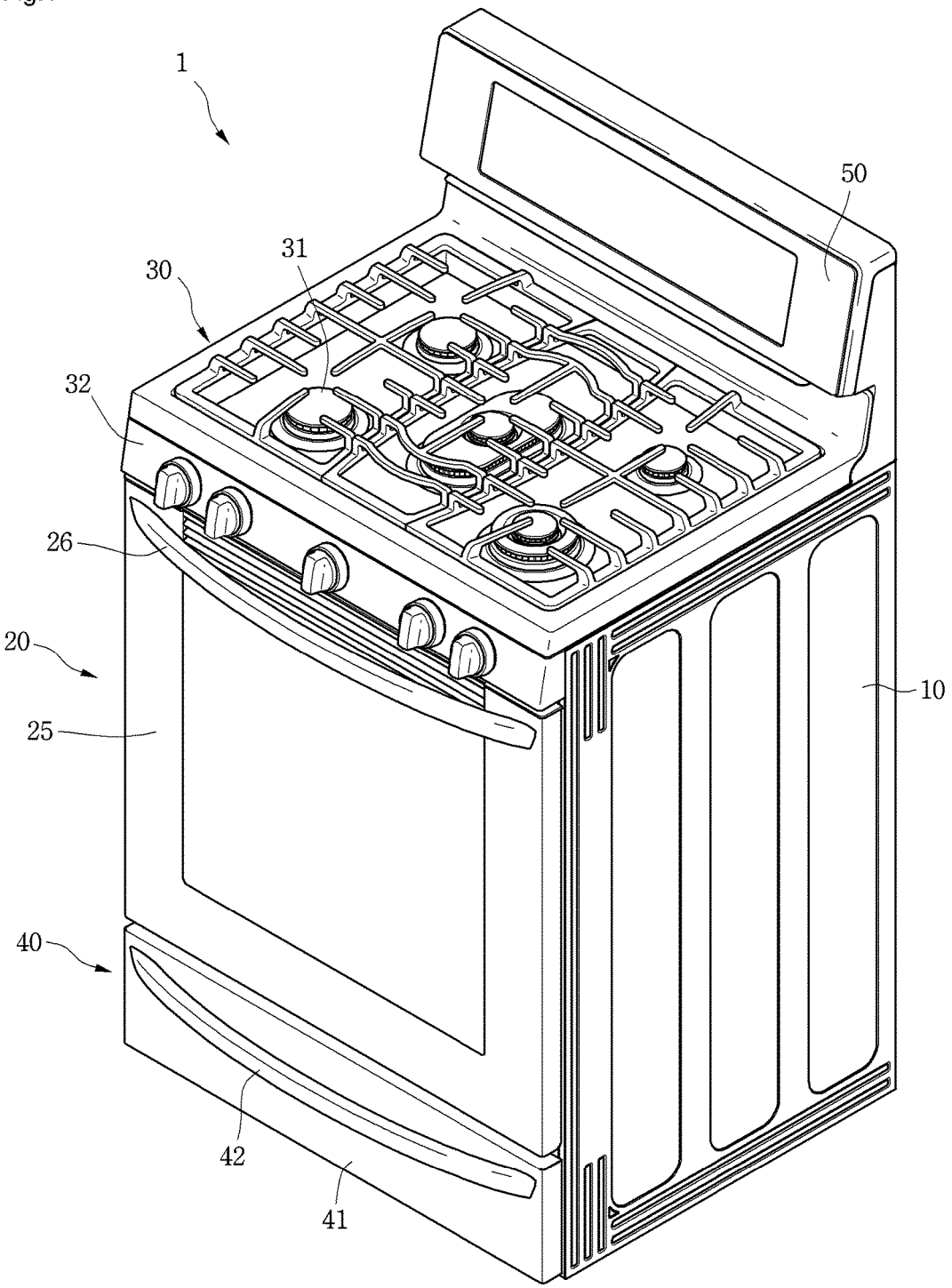
FIG. 1 is a perspective view of a cooking device according to one embodiment of the present invention.

Reference will now be made in detail to the embodiments of the present disclosure, examples of which are illustrated in the accompanying drawings.

Hereinafter, exemplary embodiments of the present disclosure will be described with reference to the accompanying drawings. Regarding the reference numerals assigned to the elements in the drawings, it should be noted that the same elements may be designated by the same reference numerals, wherever possible, even though they are shown in different drawings. Also, in the description of embodiments, detailed description of well-known related structures or functions may be omitted when it is deemed that such description may cause ambiguous interpretation of the present disclosure.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected," "coupled," and "joined" to the latter via another component.

Figure 2:
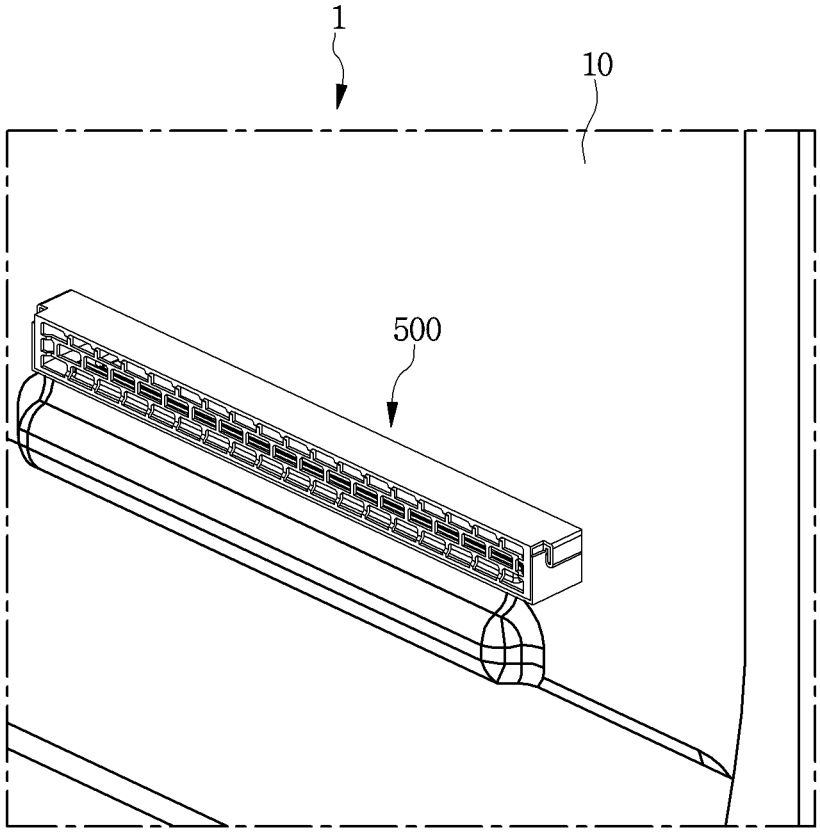
FIG. 2 is a rear perspective view partially illustrating the cooking device shown in FIG. 1.
Figure 3:
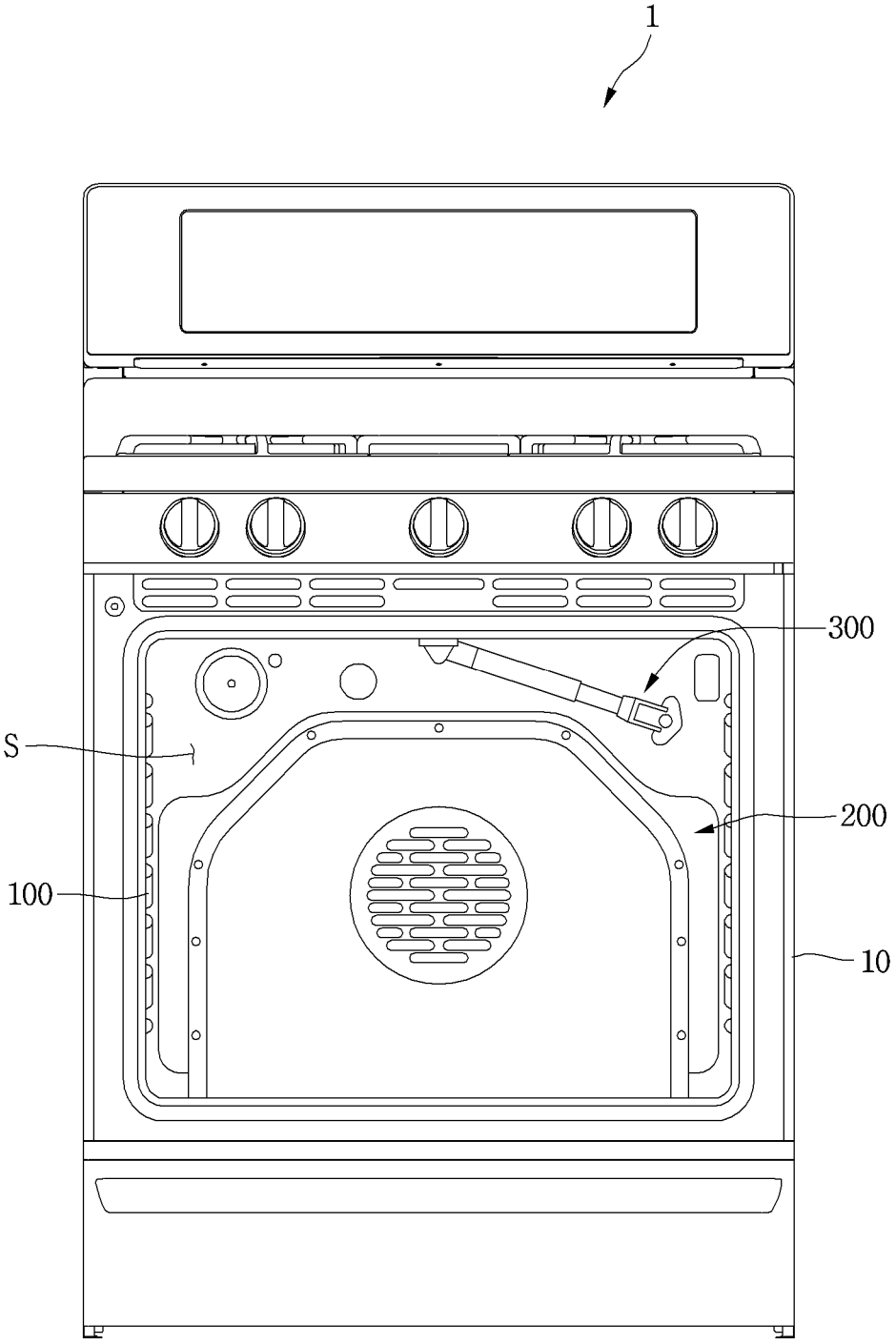
FIG. 3 is a front view when a door is removed from the cooking device shown in FIG. 1.
Figure 4:
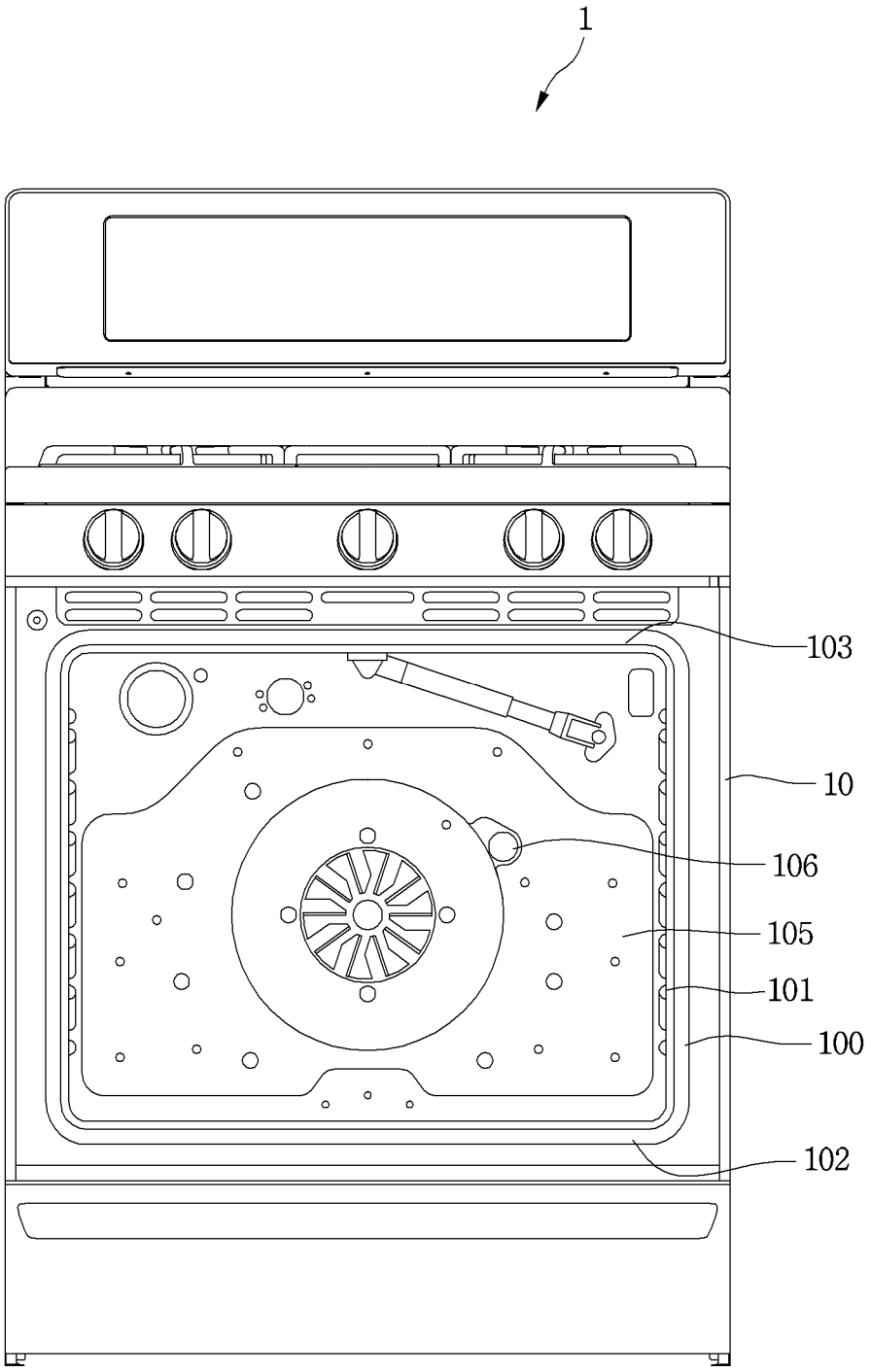
FIG. 4 is a view when a burner assembly is removed from the cooking device shown in FIG. 2.

FIG. 1 is a perspective view of a cooking device according to one embodiment of the present invention, FIG. 2 is a rear perspective view partially illustrating the cooking device shown in FIG. 1, FIG. 3 is a front view when a door is removed from the cooking device shown in FIG. 1, and FIG. 4 is a view when a burner assembly is removed from the cooking device shown in FIG. 2.

Referring to FIGS. 1 to 4, a cooking device 1 may include some or all of an outer case 10, an oven unit 20, a cook-top unit 30, a drawer unit 40, a control unit 50, and an air guide unit 500.

The outer case 10 forms an exterior of the cooking device 1. The outer case 10 may be formed of a metallic material in consideration of aspects of design, strength, etc. Various types of components forming the cooking device 1 are embedded in the outer case 10.

The oven unit 20 may be provided in the center of the cooking device 1. The above oven unit 20 may include a door 25, a door handle 26, a cavity 100, a burner assembly 200, and an upper burner 300.

The door 25 opens and closes a cooking space S in which food to be described below is cooked. The above door 25 may be rotatably connected to the outer case 10. For example, the door 25 may open and close the cooking space S in a pull-down method in which an upper end is vertically rotated about a lower end. In the embodiment, an operating method of the door 25 is not limited.

The door handle 26 may be provided at an upper end of a front surface of the door 25. The door handle 26 may be provided to perform a user operation for rotating the door 25.

The cavity 100 is provided in the outer case 10, and is formed in the cooking space S in which food is cooked. The above cavity 100 may be formed to have, for example, a rectangular parallelepiped shape of which a front surface is open. The shape is not limited thereto, and the shape of the cavity 100 may be provided in another shape in which a cooking space is able to be formed. Hereinafter, the cavity 100 will be described with reference to the following drawings in detail.

The burner assembly 200 is installed in the cavity 100, and may cook food accommodated in the cooking space S by burning a gas.

Hereinafter, the burner assembly 200 will be described with reference to the following drawings in detail.

The upper burner 300 is a component for cooking the food accommodated in the cooking space S, and may operate simultaneously with or independently from the burner assembly 200. The above upper burner 300 is installed at an upper wall of the cavity 100, and may provide heat to food from above the food in the cooking space S.

The cook-top unit 30 is provided at an upper portion of the cooking device 1. The above cook-top unit 30 may include a plurality of cook-top burners 31. The cook-top burners 31 may cook food by heating a container in which food is put or directly heating the food using a flame generated by burning the gas.

An operational unit 32 for operating the plurality of cook-top burners 31 may be disposed on a front end of the cook-top unit 30. Here, the operational unit 32 may be disposed on an upper surface of the cook-top unit 30.

The cook-top unit 30 may include one or more electric heaters. Here, the one or more electric heaters may be unexposed to the outside of the cook-top unit 30. Like this, a heating source included in the cook-top unit 30 may use one of various types of heating sources.

The drawer unit 40 serves to keep a container in which food is put at a predetermined temperature. A drawer 41 in which the container is accommodated may be provided in the drawer unit 40. The drawer 41 may be inserted into or withdrawn from the cooking device 1 in a sliding method. A handle 42 gripped by a user may be provided on a front surface of the drawer 41.

The control unit 50 may receive an operation signal for operating the cooking device 1, specifically, an operation signal for operating at least one of the oven unit 20, the cook-top unit 30, and the drawer unit 40. Further, the control unit 50 may display a variety of information on the operation of the cooking device 1 to the outside.

The air guide unit 500 is in communication with the burner assembly 200, and exposed to the outside of the outer case 10 so that air outside the outer case 10 is introduced into the burner assembly 200. To this end, one side of the air guide unit 500 is in communication with the burner assembly 200, and the other side of the air guide unit 500 is exposed to the outside of the outer case 10.

The cooking device 1 according to the embodiment may introduce secondary air used for burning in the burner assembly 200 from the outside of the cooking device through the air guide unit 500.

Therefore, in the embodiment, the secondary air used for burning in the burner assembly 200 may be introduced into the burner assembly 200 in a more fresh state.

Hereinafter, main components according to the embodiment will be described in more detail.

Figure 5:
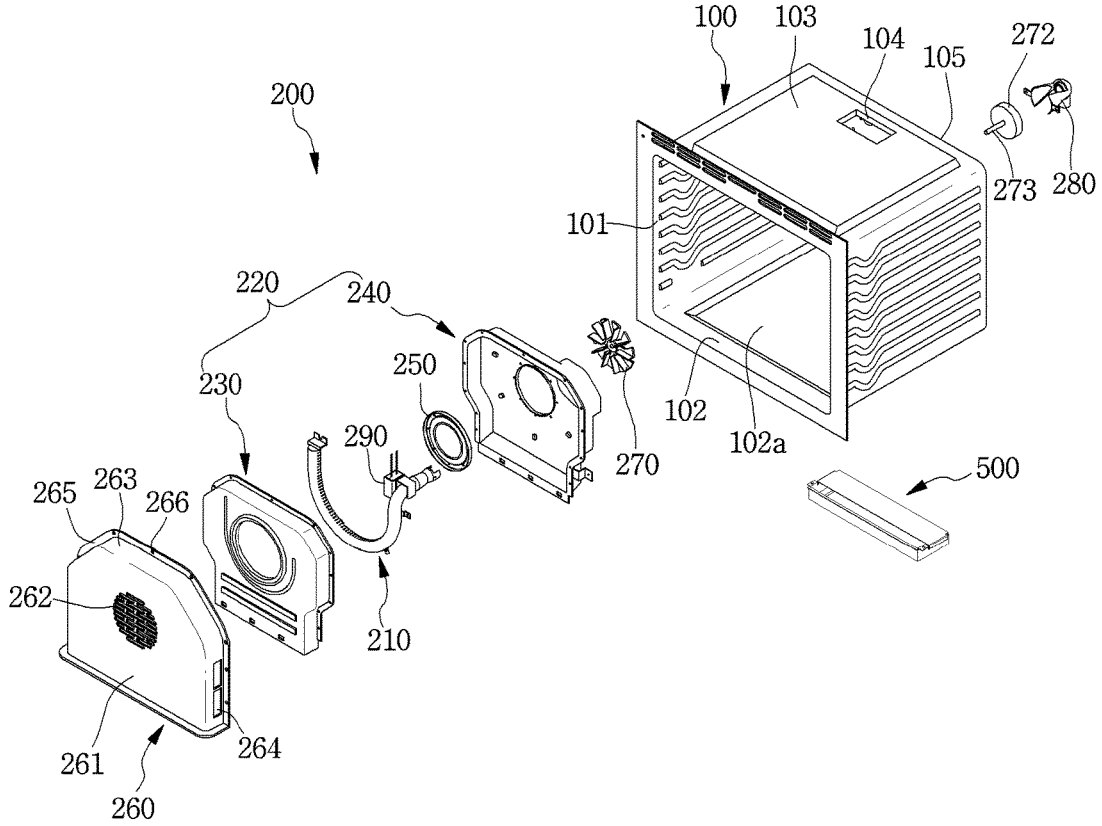
FIG. 5 is a view for describing a cavity, a burner assembly, and an air guide unit of the cooking device shown in FIG. 1.
Figure 6:
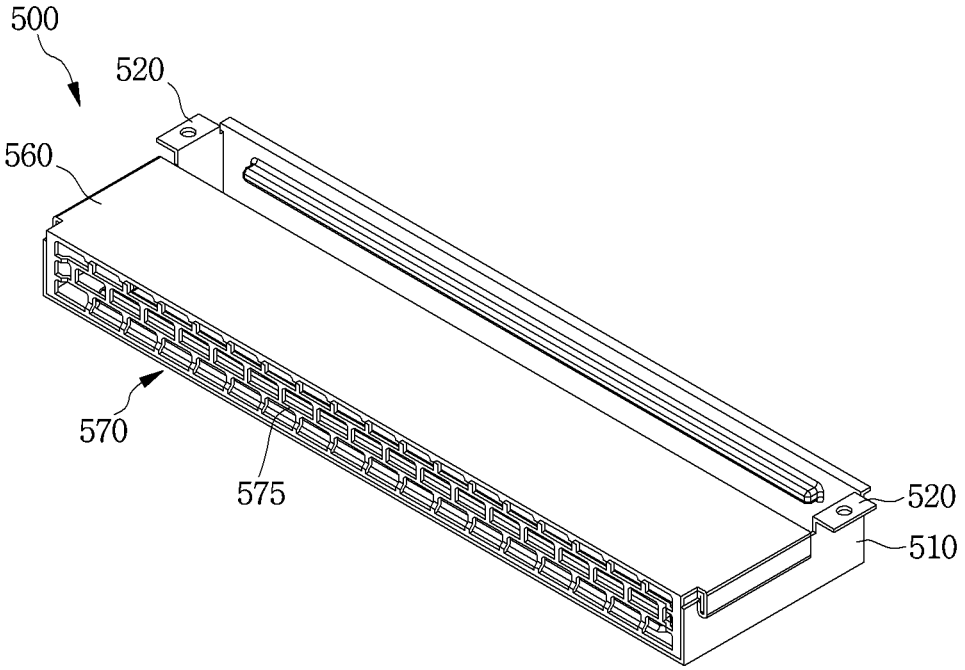
FIG. 6 is a perspective view of the air guide unit shown in FIG. 5.
Figure 7:
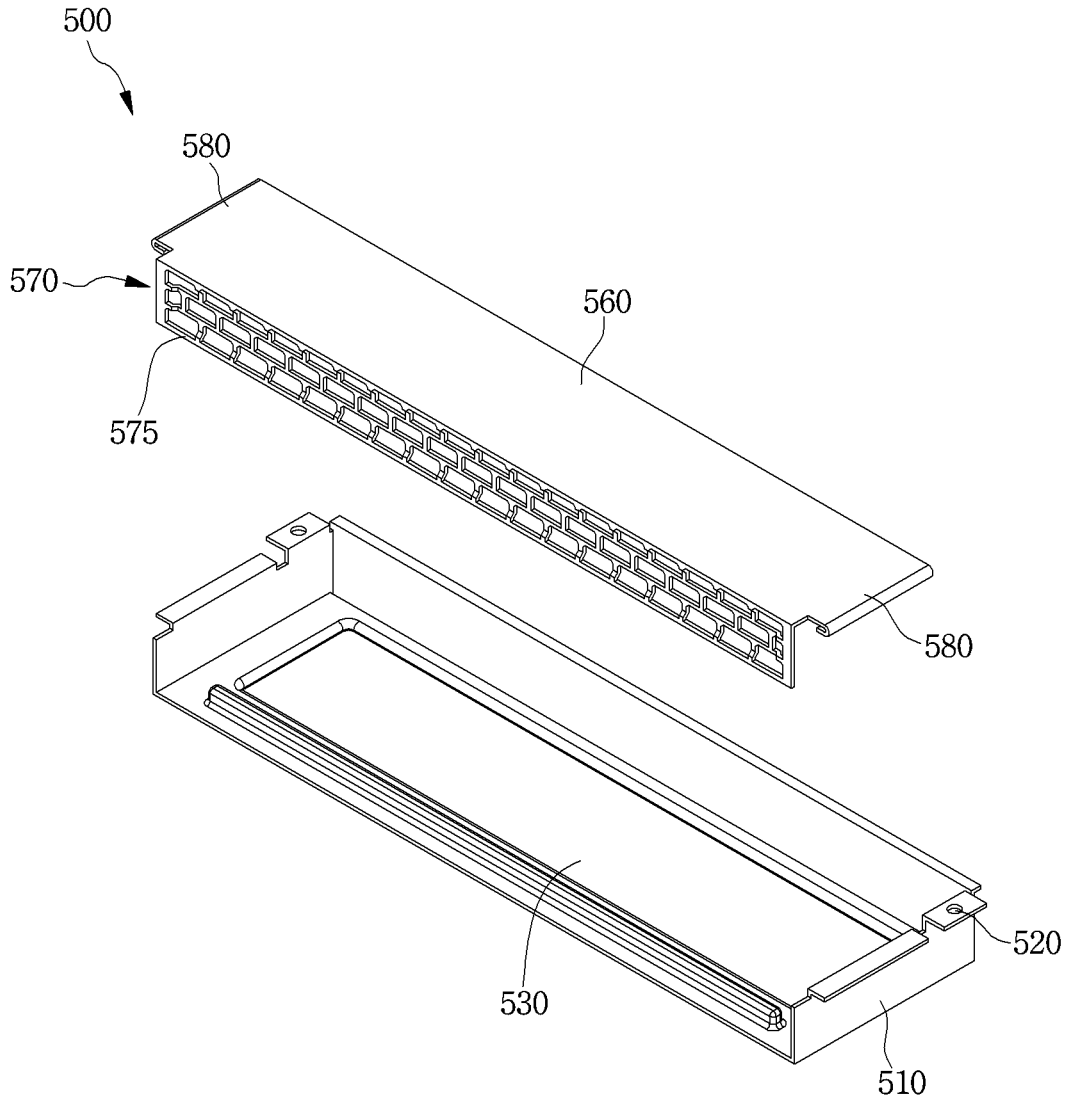
FIG. 7 is an exploded perspective view of the air guide unit shown in FIG. 6.
Figure 8:
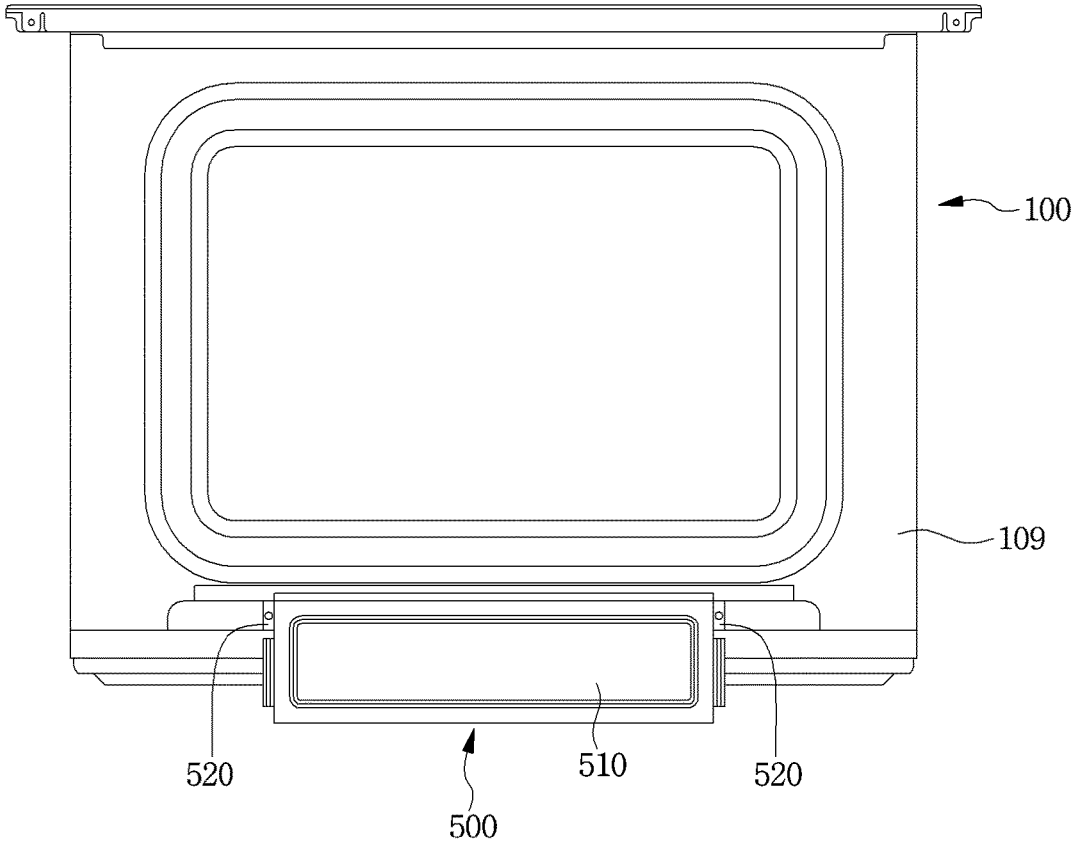
FIG. 8 is a view for describing an assembly of the air guide unit and the cavity shown in FIG. 5.

FIG. 5 is a view for describing a cavity, a burner assembly, and an air guide unit of the cooking device shown in FIG. 1, FIG. 6 is a perspective view of the air guide unit shown in FIG. 5, FIG. 7 is an exploded perspective view of the air guide unit shown in FIG. 6, and FIG. 8 is a view for describing an assembly of the air guide unit and the cavity shown in FIG. 5.

Referring to FIGS. 5 to 8, the cavity 100 may include two sidewalls 101, a bottom wall 102, an upper wall 103, and a rear wall 105.

In the embodiment, the term "front" is a direction toward a front surface of the cooking device 1, and the term "rear" is a direction toward a rear surface of the cooking device 1. Further, in the cavity 100, the term "front" is a direction toward the door 25 of the oven unit 20, and the term "rear" is a direction toward the rear wall 105 of cavity 100.

The burner assembly 200 may be coupled to the rear wall 105 of the cavity 100. That is, in the embodiment, since the burner assembly 200 is not located under the cavity 100 but is installed at the rear wall 105 of the cavity 100, a recessed portion 102*a* recessed downward may be formed at the bottom wall 102 of the cavity 100, and thus a capacity of the cavity 100 may be increased.

Although the burner assembly 200 is installed at the rear wall 105 of the cavity 100 in the above description, alternatively, the burner assembly 200 may be installed at one of both of the sidewalls 101 of the cavity 100.

The burner assembly 200 may include some or all of a burner 210, a burner cover 220, a stabilizer 250, an assembly cover 260, a fan 270, a fan motor 272, and a nozzle holder 280.

The burner 210 is a component for generating the flame by burning the gas. The burner 210 may be formed in a tube shape of a roughly "U" shape.

The burner cover 220 is a component for covering the burner 210. The burner cover 220 may include a first cover 230 and a second cover 240. The first cover 230 is located in front of the burner 210 to cover the front of the burner 210, and the second cover 240 is located behind the burner 210 to cover the rear of the burner 210.

The stabilizer 250 is provided in the burner cover 220, and is a component for stabilizing the flame generated from the burner 210.

As the assembly cover 260 is a component for protecting the burner 210 and the burner cover 220, the assembly cover 260 is provided in front of the burner cover 220. The assembly cover 260 may block the movement of food leftovers or the like to the burner cover 220, and furthermore, to the burner 210 during a cooking process of the food.

The above assembly cover 260 may include a front plate 261, an extension part 263 extending from the front plate 261 toward the rear wall 105 of the cavity 100, and a contact part 265 bent from the extension part 263.

An air inlet 262 into which air of the cavity 100 is suctioned is formed in the front plate 261, and an air outlet 264 through which air heated by the burner 210 is discharged to the cavity 100 is formed in the extension part 263. As another example, the air outlet 264 may be formed in the front plate 261 or formed in each of the front plate 261 and the extension part 263.

The contact part 265 may be in contact with the rear wall 105 of the cavity 100 while covering the burner cover 220. A fastening hole 266 to which a fastening member which is not shown is coupled may be provided in the contact part 265.

When the assembly cover 260 is coupled to the rear wall 105 of the cavity 100 by the fastening member, a lower end of the assembly cover 260 may be in contact with the bottom wall 102 of the cavity 100. That is, the front plate 261 and lower ends of the extension part 263 and the contact part 265 may be in contact with the bottom wall 102 of the cavity 100. Alternatively, the front plate 261 and the extension part 263 may be in contact with the bottom wall 102 of the cavity 100.

At this point, the assembly cover 260 may be in contact with the bottom wall 102 of the cavity 100 in between the recessed portion 102*a* of the bottom wall 102 of the cavity 100 and the rear wall 105.

The fan 270 is located in the cavity 100. The fan motor 272 is disposed between the rear wall 105 of the cavity 100 and the outer case 10 (see FIG. 1). A shaft 273 of the fan motor 272 may pass through the rear wall 105 of the cavity 100 to be coupled to the fan 270. The fan motor 272 may be fixed to the rear wall 105 of the cavity 100 or the outer case 10 by a motor mount which is not shown.

The nozzle holder 280 may be located between the rear wall 105 of the cavity 100 and the outer case 10. For example, the nozzle holder 280 may be fixed to the rear wall 105 of the cavity 100. As another example, when an insulating material is displaced on the outer side of the cavity 100, the nozzle holder 280 may be installed at the insulating material. The nozzle holder 280 may be arranged with the burner 210 passing through the rear wall 105 of the cavity 100 and may inject the gas into the burner 210.

The air guide unit 500 may include a guide body 510 and a guide cover 560.

The guide body 510 is mounted on the burner assembly 200 to communicate with the burner assembly 200. Specifically, the guide body 510 may be mounted on a lower surface 109 of the cavity 100 to communicate with the burner cover 220.

The guide body 510 may include a screw fastening hole 520 and a receiver 530.

The screw fastening hole 520 passes through a fastening member such as a screw member for screw-coupling with the cavity 100 and at least one screw fastening hole 520 is provided. Hereinafter, the embodiment will be described assuming that a pair of screw fastening holes 520 are provided.

The pair of screw fastening holes 520 are provided in upper portions of both side surfaces of the guide body 510. Each fastening member passes through each of the screw fastening holes 520 to be screw-coupled with the lower surface 109 of the cavity 100, and thus the cavity 100 and the guide body 510 are screw-coupled.

The receiver 530 is provided on a lower surface of the guide body 510, and forms a predetermined accommodation space. The receiver 530 is located under the lower surface 109 of the cavity 100. The above receiver 530 may be formed by a forming process. The receiver 530 may store foreign materials generated during cooking in the cooking device 1 or water used during cleaning of the cavity 100 using the above accommodation space, and thus the foreign materials or water may be prevented from passing through the guide body 510 and the guide cover 560 and leaking to the outside of the outer case 10.

Thus, the receiver 530 may prevent contamination caused by the foreign materials generated during cooking in the cooking device 1 or the water used during cleaning of the cavity 100, i.e., the contamination of the bottom of the cooking device 1, specifically, the bottom of the outer case 10.

Further, the receiver 530 may also accommodate unexpected foreign materials or the like to be introduced through the guide cover 560, and thus, even when the foreign materials or the like are introduced from the outside of the cooking device 1 through the guide cover 560, the foreign materials or the like may be prevented from being introduced into the burner assembly 200.

The guide cover 560 is mounted on the guide body 510 and exposed to the outside of the outer case 10 (see FIG. 2). Specifically, the guide cover 560 covers a part of an upper portion of the guide body 510 so that air introduced from the outside of the outer case 10 is introduced into the burner assembly 200.

An air inlet 570 through which air outside the outer case 10 is introduced is formed in the above guide cover 560.

The air inlet 570 is exposed to the outside of the outer case 10, and includes a plurality of holes 575. The plurality of holes 575 may be separated a predetermined distance from each other and disposed in a lengthwise direction of the guide cover 560. Furthermore, the plurality of holes 575 may be disposed in a form of at least one row in the lengthwise direction of the guide cover 560. Hereinafter, the embodiment will be described assuming that the plurality of holes 575 are disposed in a form of three rows in the lengthwise direction of the guide cover 560.

The plurality of holes 575 may have roughly circular or tetragonal shapes. Although not limited thereto, the shapes of the plurality of holes 575 may be other shapes through which the air is able to be introduced. Hereinafter, the embodiment will be described assuming that the plurality of holes 575 have roughly tetragonal shapes.

In the embodiment, fresh secondary air is only introduced from the outside of the outer case 10 through the plurality of holes 575, and in addition, the introduction of foreign materials or the like having a predetermined volume, exclusive of the secondary air, may be blocked. That is, the plurality of holes 575 may prevent the foreign materials or the like having the size of each of the plurality of holes 575 or more from being introduced into the guide body 510.

Further, a cover mounting part 580 is provided on each of side surfaces of the guide cover 560. The cover mounting part 580 is bent on each of the side surfaces of the guide body 510 to fix the guide cover 560 on the guide body 510. Therefore, the guide cover 560 may be stably and fixedly mounted on the guide body 510.

Hereinafter, a detailed operation of the air guide unit 500 of the above cooking device 1 according to the embodiment will be described in detail.

Figure 9:
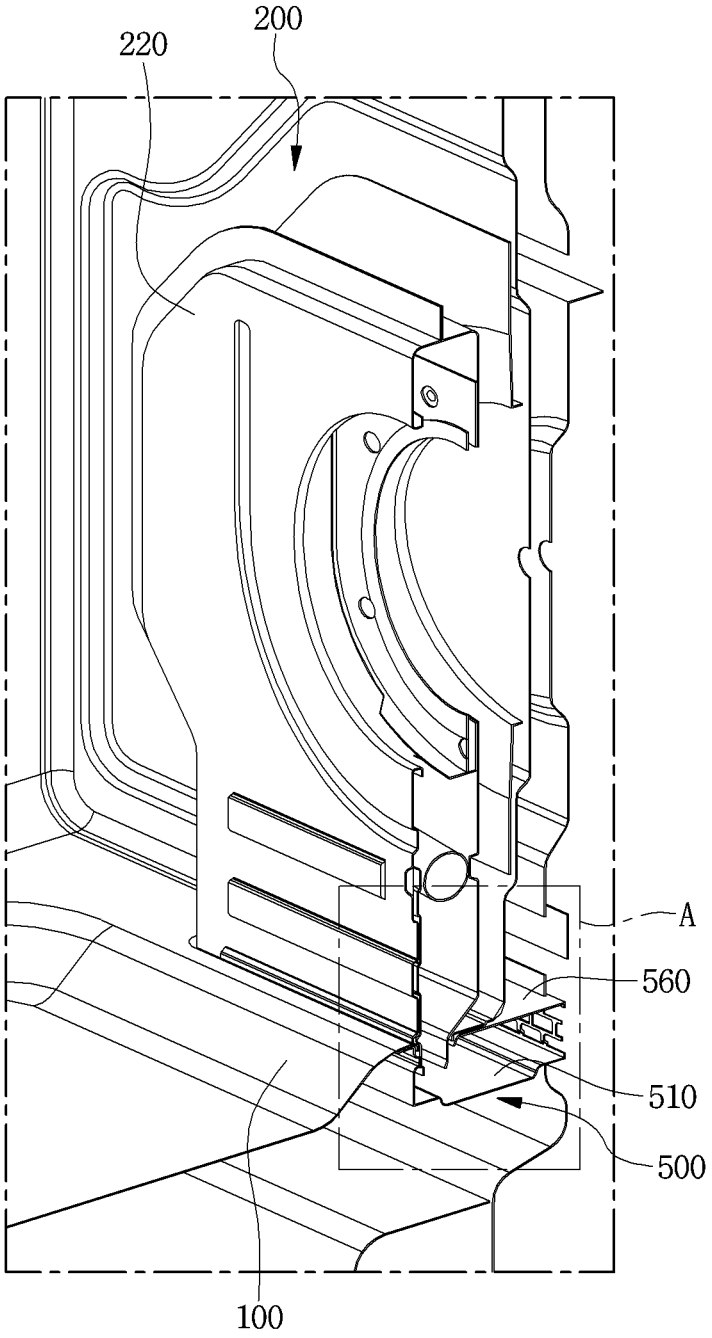
FIGS. 9 and 10 are views for describing an operation of the air guide unit shown in FIG. 5.
Figure 10:
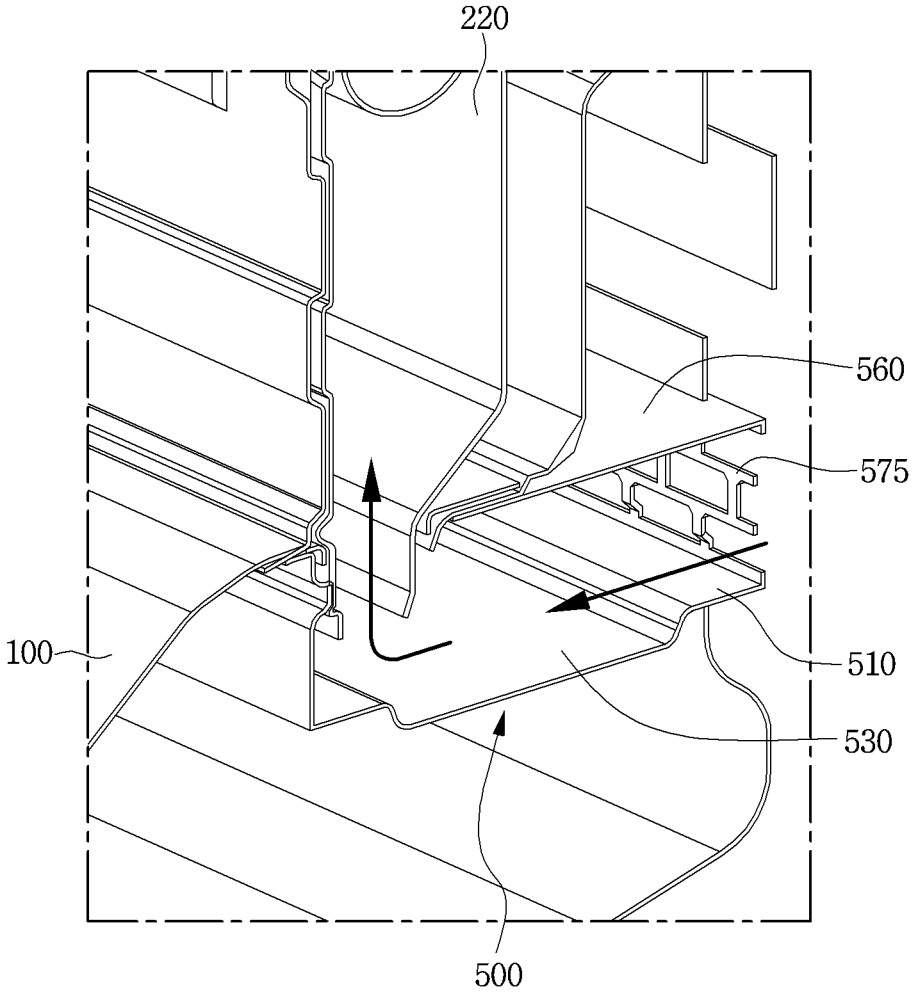

FIGS. 9 and 10 are views for describing an operation of the air guide unit shown in FIG. 5.

Referring to FIGS. 9 and 10, first, fresh secondary air outside the cooking device 1 is introduced into the guide body 510 of the air guide unit 500 through the plurality of holes 575 of the guide cover 560 of the air guide unit 500.

Then, the secondary air introduced into the guide body 510 flows into the burner cover 220 to be used for combustion of the burner 210 (see FIG. 5). At this point, a part of the burner cover 220 may be inserted into the air guide unit 500 so that the secondary air introduced into the guide body 510 smoothly flows into the burner cover 220.

Thus, the cooking device 1 according to the embodiment is able to secure the sufficient amount of the fresh secondary air during the combustion of the burner 210, and thereby the combustion performance of the burner 210 can be improved significantly.

Furthermore, the receiver 530 of the guide body 510 is able to accommodate the foreign materials, water, or the like during cleaning or cooking in the cavity 100, and thereby the foreign materials, water, or the like can be prevented from leaking to the outside of the cooking device 1. Further, even when unexpected foreign materials or the like are introduced from the outside of the cooking device 1, the receiver 530 can accommodate the unexpected foreign materials or the like, and thus the foreign materials can be prevented from being introduced into the burner assembly 200.

Figure 11:
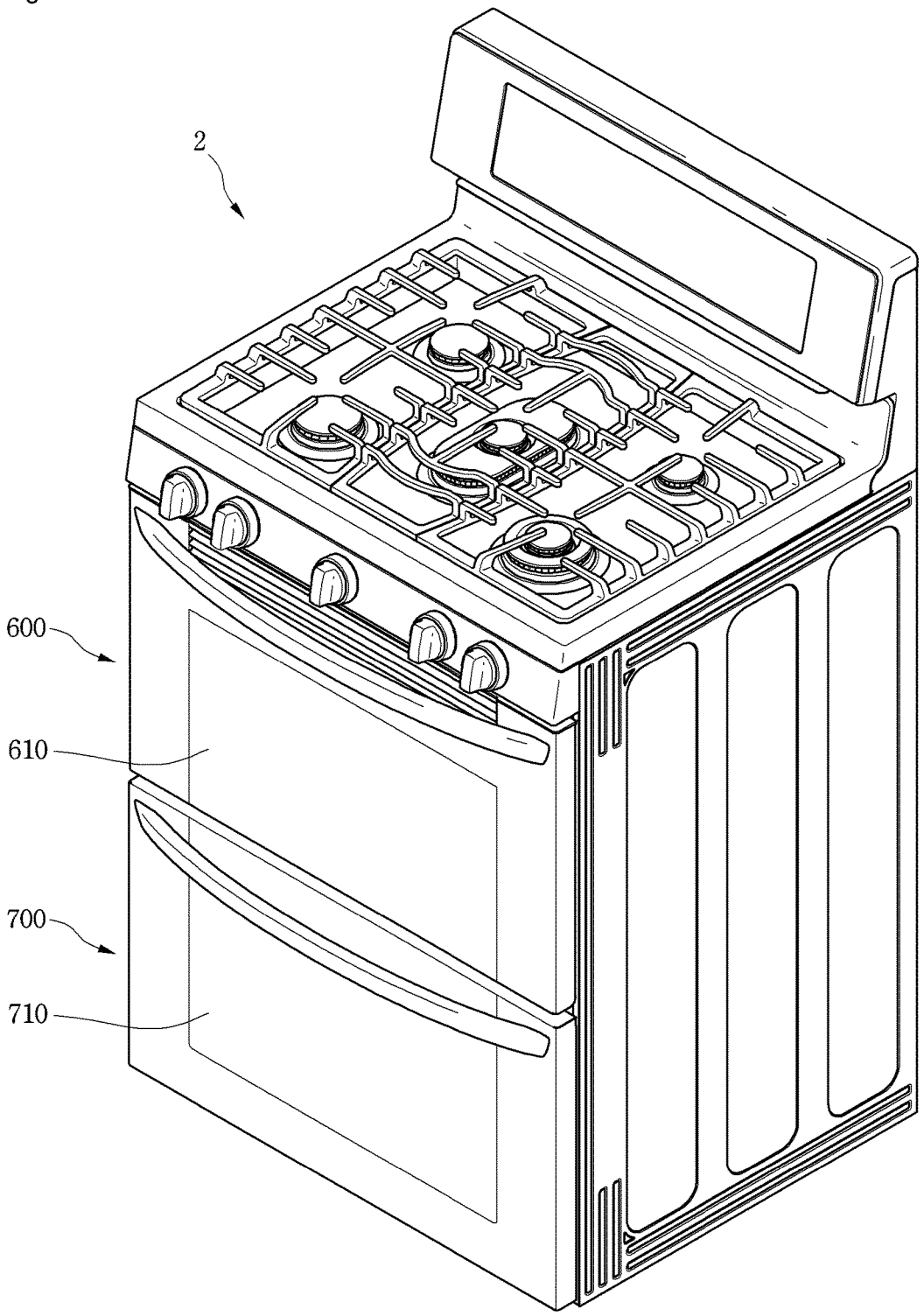
FIG. 11 is a perspective view of a cooking device according to another embodiment of the present invention.
Figure 12:
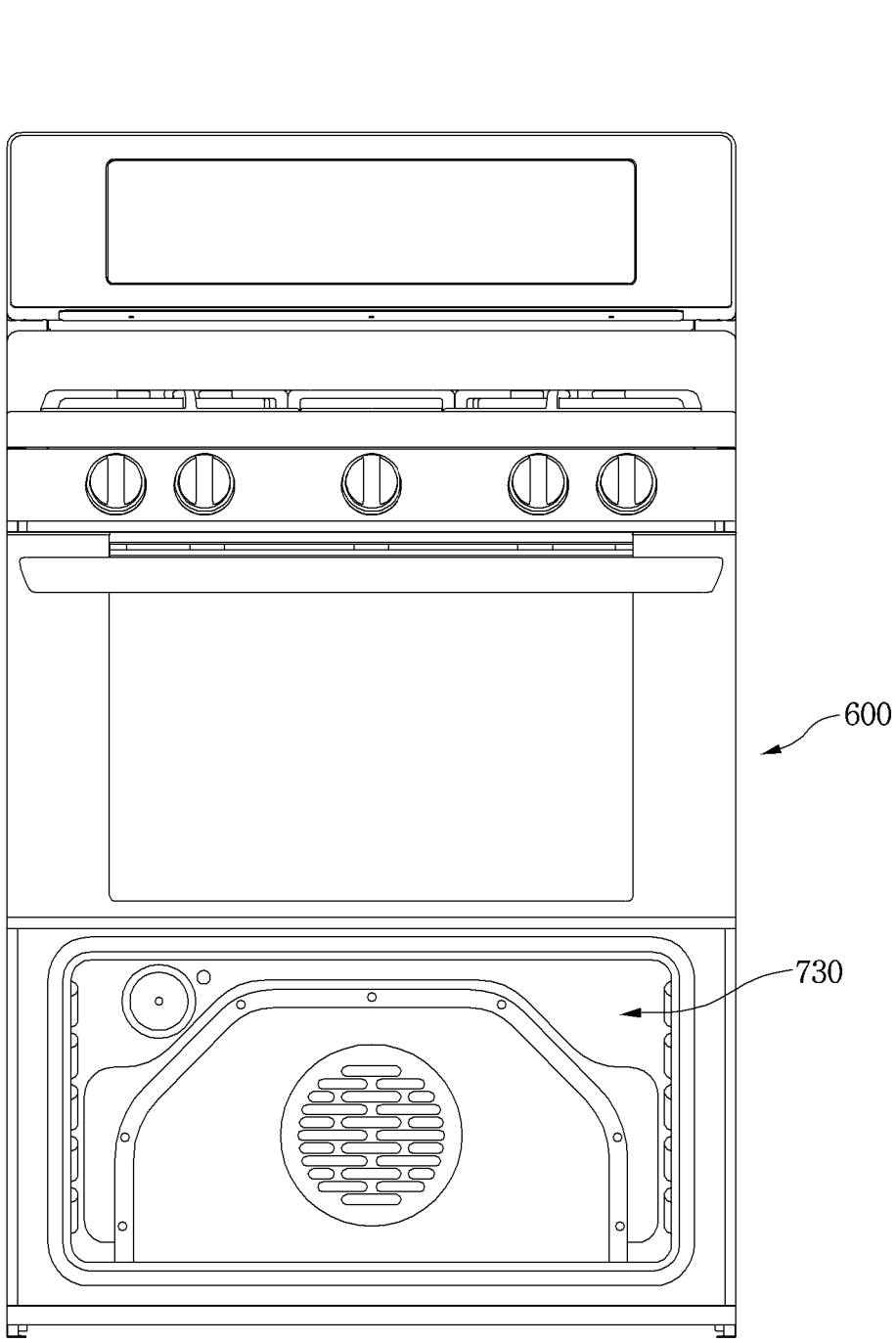
FIG. 12 is a front view of the cooking device when a second door is separated from the cooking device shown in FIG. 11.

FIG. 11 is a perspective view of a cooking device according to another embodiment of the present invention, and FIG. 12 is a front view of the cooking device when a second door is separated from the cooking device shown in FIG. 11.

As a cooking device 2 according to the embodiment is similar to the cooking device 1 described in the previous embodiment, the embodiment will be described based on differences from the cooking device 1 described in the previous embodiment.

Referring to FIGS. 11 and 12, the cooking device 2 may include a plurality of oven units 600 and 700.

The plurality of oven units 600 and 700 may include a first oven unit 600 and a second oven unit 700 located under the first oven unit 600. The first oven unit 600 and the second oven unit 700 may include doors 610 and 710, respectively.

A burner assembly 730 is provided at one or each of the first oven unit 600 and the second oven unit 700. As the structure of the burner assembly 730 is the same as that of the burner assembly described in the previous embodiment, hereinafter, a detailed description thereof will be omitted.

FIG. 12 shows that the burner assembly 730 is provided at the second oven unit 700 as an example, but the burner assembly 730 may be provided at the first oven unit 600 or provided at each of the first oven unit 600 and the second oven unit 700.

Even though all the elements of the embodiments are coupled into one or operated in the combined state, the present disclosure is not limited to such an embodiment. That is, all the elements may be selectively combined with each other without departing from the scope of the invention. Furthermore, when it is described that one comprises (or includes or has) some elements, it should be understood that it may comprise (or include or have) only those elements, or it may comprise (or include or have) other elements as well as those elements if there is no specific limitation. Unless otherwise specifically defined herein, all terms comprising technical or scientific terms are to be given meanings understood by those skilled in the art. Like terms defined in dictionaries, generally used terms need to be construed with meanings used in technical contexts and are not construed with ideal or excessively formal meanings unless otherwise clearly defined herein.

Although embodiments have been described with reference to a number of illustrative embodiments thereof, it will be understood by those skilled in the art that various changes in form and details may be made therein without departing from the spirit and scope of the invention as defined by the appended claims. Therefore, the preferred embodiments should be considered in a descriptive sense only and not for purposes of limitation, and also the technical scope of the invention is not limited to the embodiments. Furthermore, the present invention is defined not by the detailed description of the invention but by the appended claims, and all differences within the scope will be construed as being comprised in the present disclosure.

What is claimed is:

1. A cooking device comprising:

an outer case configured to form an exterior thereof;

a cavity provided in the outer case and configured to form a cooking space in which food is cooked;

a burner assembly installed in the cavity and at a rear wall of the cavity, the burner assembly configured to cook the food by burning a gas; and an air guide unit mounted on the burner assembly to communicate with the burner assembly, the air guide unit being exposed to a rear surface of the rear wall of the outer case so that air outside the outer case is guided to the burner assembly, wherein the air guide unit includes:

a guide body mounted at a lower surface of the cavity to communicate with the burner assembly, the guide body being exposed to the rear surface of the rear wall of the outer case; and a guide cover mounted on the guide body and exposed to the outside of the outer case, wherein an air inlet through which air outside the outer case is introduced is formed in the guide cover, and the air inlet is exposed to the outside of the outer case and provided with a plurality of holes, wherein the burner assembly comprises:

a burner configured to generate a flame by burning the gas; and a burner cover configured to cover the burner, wherein the burner assembly is installed at a rear wall of the cavity in the cavity, and the air guide unit is installed at a lower surface of the cavity to communicate with the burner cover, wherein an assembly cover is provided in front of the burner cover, and the assembly cover is in contact with the rear wall of the cavity while covering the burner cover, and a lower end of the assembly cover is in contact with a bottom wall of the cavity, wherein the burner cover covers a front surface of the burner and a rear surface of the burner, wherein the guide body includes a receiver recessed downward from a lower surface of the guide body to form a predetermined accommodation space, the receiver being disposed below the lower surface of the cavity.

2. The cooking device of claim 1, wherein at least one screw fastening hole for screw-coupling with the cavity is formed in the guide body.

3. The cooking device of claim 1, wherein the guide cover covers a part of an upper portion of the guide body so that air introduced from the outside of the outer case is guided to the burner assembly.

4. The cooking device of claim 1, wherein the plurality of holes are separated a predetermined distance from each other and disposed in a lengthwise direction of the guide cover.

5. The cooking device of claim 1, wherein the plurality of holes are disposed in a form of at least one row in a lengthwise direction of the guide cover.

6. The cooking device of claim 1, wherein the plurality of holes have circular or tetragonal shapes.

7. The cooking device of claim 1, wherein a cover mounting part is provided on each of side surfaces of the guide cover, and the cover mounting part is bent on each of the side surfaces of the guide body to fix the guide cover to the guide body.

8. The cooking device of claim 1, wherein the burner assembly is located in the cavity.

9. The cooking device of claim 1, wherein the burner cover includes:

a first cover disposed at a front side of the burner to cover the front surface of the burner, and a second cover disposed at a rear side of the burner to cover the rear surface of the burner.

* * * * *